United States Patent [19]

Winkelvoss

[11] 4,119,117

[45] Oct. 10, 1978

[54] VALVE MEANS OF A DEVICE FOR REMOVING LUBRICATING OIL

[75] Inventor: Dieter Winkelvoss, Einbeck, Fed. Rep. of Germany

[73] Assignee: Dresser Europe S.A. "LeSouverain" Boulevard du Souverain, Brussels, Belgium

[21] Appl. No.: 780,879

[22] Filed: Mar. 24, 1977

[30] Foreign Application Priority Data

Apr. 9, 1976 [DE] Fed. Rep. of Germany ..... 2615464

[51] Int. Cl.[2] ..... F16K 17/00

[52] U.S. Cl. ..... 137/456; 137/DIG. 8; 184/1.5

[58] Field of Search ..... 137/DIG. 8, 495, 494, 137/464, 456; 184/1.5

[56] References Cited

U.S. PATENT DOCUMENTS

| | | | |
|---|---|---|---|
| 1,950,121 | 3/1934 | McKee | 137/DIG. 8 |
| 1,986,476 | 1/1935 | Ironside | 184/1.5 UX |
| 2,169,683 | 8/1939 | Dunham et al. | 137/DIG. 8 |
| 2,536,492 | 1/1951 | Dunn et al. | 184/1.5 X |
| 2,587,375 | 2/1952 | Paulsen | 137/DIG. 8 |
| 3,741,240 | 6/1973 | Berriman | 137/495 X |

*Primary Examiner*—David H. Brown

*Attorney, Agent, or Firm*—Allison C. Collard; Thomas M. Galgano

[57] ABSTRACT

In a suction apparatus for removing lubricating dirty oil from the crankcase of internal combustion engines a vacuum tank is connected to the crankcase by a suction line via a control valve which shuts off the suction line on completion of the oil suction process.

14 Claims, 2 Drawing Figures

28
26
11
29
27
25
24
23
22
12
30
21
VACUUM
TANK
41
40
20
19
16
14
18
17
13
15
42
43
OIL SUMP

26

11
24
23
41
19
12
44
32
31
16
14
18
40
33
17
13
VACUUM
TANK
15
42
43
OIL SUMP

VALVE MEANS OF A DEVICE FOR REMOVING LUBRICATING OIL

The invention relates to a valve means of a device for removing lubricating oil from internal combustion engines, gear boxes or the like and particularly to valve means of a device which facilitates the removal of lubricating dirty oil from the crankcase of a motor vehicle engine.

This device comprises a vacuum tank for the oil to be received in and a suction line connecting said tank to the oil chamber of the engine. Generally this suction line consists of a hose the end of which is adapted for connection to a dipstick well of the engine. Due to the negative pressure condition of the vacuum tank oil is drawn from the engine's crankcase into the vacuum tank.

To prevent oil from flowing back out of the vacuum tank when the latter is emptied by introduction of compressed air, a non-return valve is fitted in this suction line. When all of the oil has been drawn from the engine's crankcase, air is sucked in and enters the vacuum tank via the suction line. Such infiltrated air cannot be prevented by a non-return valve. Therefore after each suction process the vacuum in the tank must be regenerated, whereby the operation of the device is inefficient and complicated.

It is an object of the present invention to avoid these disadvantages and to provide a valve means which automatically shuts off the suction line on completed suction removal of the dirty lubricating oil when infiltrated air has entered into the suction line.

According to this invention a valve means controlled as a function of pressure inside the vacuum tank is fitted in the suction line connecting the engine's oil chamber to the vacuum tank to automatically shut off the suction line as soon as the suction removal process is completed. This valve means responds wherever the pressure prevailing inside the suction line suddenly increases due to ingress of air on completion of the removal process.

It is a further object of the present invention to provide a valve means with a control member loaded by a pretensioned spring. The control port of said control member is in communication with the vacuum tank when the valve is open and the tension of the spring of said member is adapted to the operational underpressure inside the vaccum tank. For as long as this underpressure is being maintained, the spring action of the control member would be overcome by said negative pressure and the valve would remain open to connect the suction line to the vacuum tank so that oil is drawn from the internal combustion engine into the vacuum tank. Should the underpressure inside the suction line suddenly reduce due to ingress of infiltrated air on completion of the suction removal process, however, the spring force would predominate and close the valve to thereby shut off the suction line.

According to a further object of the present invention such automatic shutoff of the suction line shall also be practicable whenever during the suction process there is an ingress of infiltration air into the suction line. A separate control line connected to the vacuum tank is for this purpose provided in communication with the control port.

The valve means preferably comprises a valve disk with a stem adapted to act on the control member and having a control port that is in communication with the vacuum tank when the valve is in open position. The control member is preferably in the form of a flexible diaphragm which is secured to said valve stem and the marginal edge of which is clamped in place by a casing that encloses the control port. The active area of this diaphragm is preferably larger than that of the valve disk so that in operation the vacuum tank underpressure acting on the diaphragm surface is greater than the spring force to which the valve disk is exposed and maintains the valve in open position.

Communication between the control port and the vacuum tank when the valve is opened is preferably established via a recess in the valve stem which is in alignment with the open end of the line to the vacuum tank while the valve is open. When the valve is closed, the control port would be checked by the valve stem that is sealingly engaged in the valve casing.

There is virtually no ingress of infiltration air into the suction line during the normal suction process so that the underpressure present in the suction line is allowed to act onto the control port via the suction line communicating with the vacuum tank when the valve is open.

Whenever the ingress of greater amounts of infiltration air must be expected in the course of a suction process, for instance due to presence of a drilled hole or bore in the dipstick well of the internal combustion engine, it is deemed recommendable to provide for the control port a separate control line connected to the vacuum tank which advantageously has a smaller cross-sectional area of flow than the suction line. The end of this control line received in the valve body is in communication with the valve stem recess when the valve is open so as to maintain the required connection between the control port and the vacuum tank.

While in rest position, i.e. in the absence of underpressure inside the vacuum tank, the valve is closed and requires to be opened manually to initiate the suction removal process which is done simply by axial shifting of the valve stem by means of an actuating member disposed on the free end of said stem. Said actuating member preferably comprises a knob which protrudes above the valve casing when the valve is closed so as to simultaneously indicate the valve position visually, the valve being open when said knob is pushed down substantially to the valve casing surface.

It is advisable to provide a detention means on the actuating means to arrest the valve when in open position and to inhibit undesired interim positions.

After the vacuum tank has become filled up with suction waste oil, it can be connected to a compressed air source by a corresponding changeover manipulation so that the compressed air entering the tank forces the oil out. In order to prevent the ingress of compressed air into the control port of the control member during this operation, it is recommendable to arrange the valve disk shiftably on the valve stem, preferably under the action of compression springs which reliably keep the valve disk in the closed position when no oil is being drawn off.

The invention will now be described in detail with reference to the accompanying drawings which show by way of example various embodiments of the invention wherein.

Figure 1:
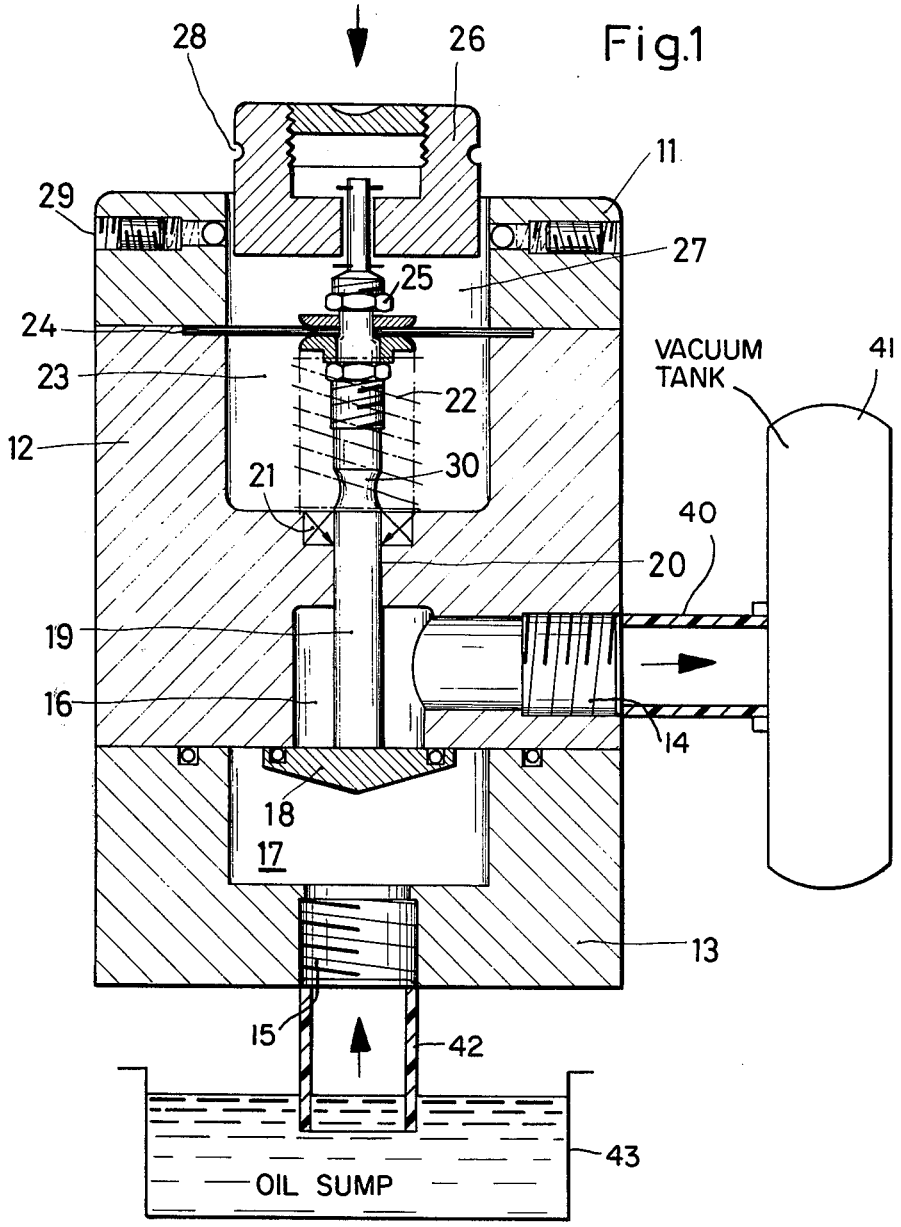
FIG. 1 is a longitudinal sectional view of the valve embodying the present invention, also showing partially schematically, the valve coupled between a vacuum tank and an oil sump by means of hoses.

With reference to the drawings there is shown a valve casing or body comprising three cylindrical portions 11, 12, 13. This valve forms the connection of a suction line with a conduit 40 to a vacuum tank 41 which receives the waste oil of an internal combustion engine. This suction line is for instance in the form of a hose, on the free end of which there is secured a tube for introduction into the dipstick well of the engine's crankcase or oil sump 43. The central portion 12 of said valve body or casing is provided with a transversal bore 14 for connection of a conduit 42 to the vacuum tank 40. The suction line 42 leading to the crankcase is connected to an axial bore 15 in the bottom casing portion 13. The transversal bore 14 opens out into a cavity 16 provided in the axis of the valve casing 11, 12, 13. The axial bore 15 opens out into a valve chamber 17 which is locked against said cavity 16 by a valve disk 18 when the valve is closed as shown in the drawings. Said valve disk 18 forms the bottom end of a valve stem 19 which is guided by an axial bore 20 with an annular seal 21 in the central casing portion 12. The portion of the stem 19 above said annular seal 21 is encompassed by a helical compression spring 22 disposed inside a control port 23 which is closed off by a flexible diaphragm 24 at the top end thereof. The marginal edge of the diaphragm 24 is clamped in place between the valve casing portions 11 and 12 while in center the diaphragm is secured to the valve stem 19 by means of the two screwjoints 25. The top end of the valve stem 19 carries an actuating member or knob 26 which is shiftably guided above said diaphragm 24 in an axial bore 27 having the same diameter as the control port 23. When the Valve disk 18 is in closed position as shown in the drawings the actuating knob 26 would protrude well above the surface of the valve casing 11 to indicate that the valve is in closed position while when the valve is open the knob 26 is depressed into the bore 27. The valve is arrested in open position with the aid of an annular groove 28 provided in the actuating knob 26 to receive therein a plurality of spring loaded balls fitted in the transversal bores 29 of the casing portion 11. The valve stem 19 has its center provided with a recess 30 which is nearly above the annular seal 21 when the valve is closed and which protrudes into the cylindrical cavity 16 when the valve is open, i.e. when the actuating knob 26 is depressed, to thereby establish communication between control port 23 and transversal bore 14 for connection of the line leading to the vacuum tank.

To draw dirty waste oil from the crankcase of a motor vehicle engine it is necessary first of all to build up an adequate underpressure inside the vacuum tank, for instance by means of an air ejector (not shown) operable on compressed air from a suitable compressed air source such as available in service stations or the like. When sufficient underpressure is present inside the vacuum tank the bores 14, 15 connected to the suction line will be opened by depressing the actuating knob 26 to bring the suction line end that is introduced into the dipstick opening into communication with the vacuum tank so that oil is drawn from the engine's crankcase due to the underpressure prevailing there. Since with the valve disk 18 in open position there is a connection provided between the transversal bore 14 in communication with the vacuum tank and the control port 23 via recess 30 of valve stem 19, the negative pressure present inside said control port 23 is substantially of the same magnitude as that in the vacuum tank. This underpressure acts on the underside of the diaphragm 24 whose active area that conforms to the cross-section of said control port 23 is greater than the active area of the valve disk 18 which is biased by compression spring 22. This implies that consequently the valve disk 18 would be maintained in open position for as long as the underpressure present in control port 23 conforms to normal working conditions.

The valve compression spring 22 is dimensioned so that small amounts of infiltration air penetrated into the suction line connected to the axial bore 15 and reducing the vacuum prevailing inside said control port 23 cannot force the diaphragm 24 from its downwardly cambered position which corresponds to the open position of the valve disk 18 which latter is thus maintained in open position. After all of the oil has been drawn from the crankcase of the engine and a major volume of air has then penetrated into the suction line, however, the resultant vacuum drop takes effect on the control port 23 via recess 30 of valve stem 19 so that under the influence of increased pressure acting on the diaphragm 24 the tension or force of valve spring 22 is overcome and the valve stem 19 is moved upward into the closed position of the valve disk 18. By this way a dependable shutoff of the suction line is ensured on completion of the oil suction removal or oil drawing process.

Figure 2:
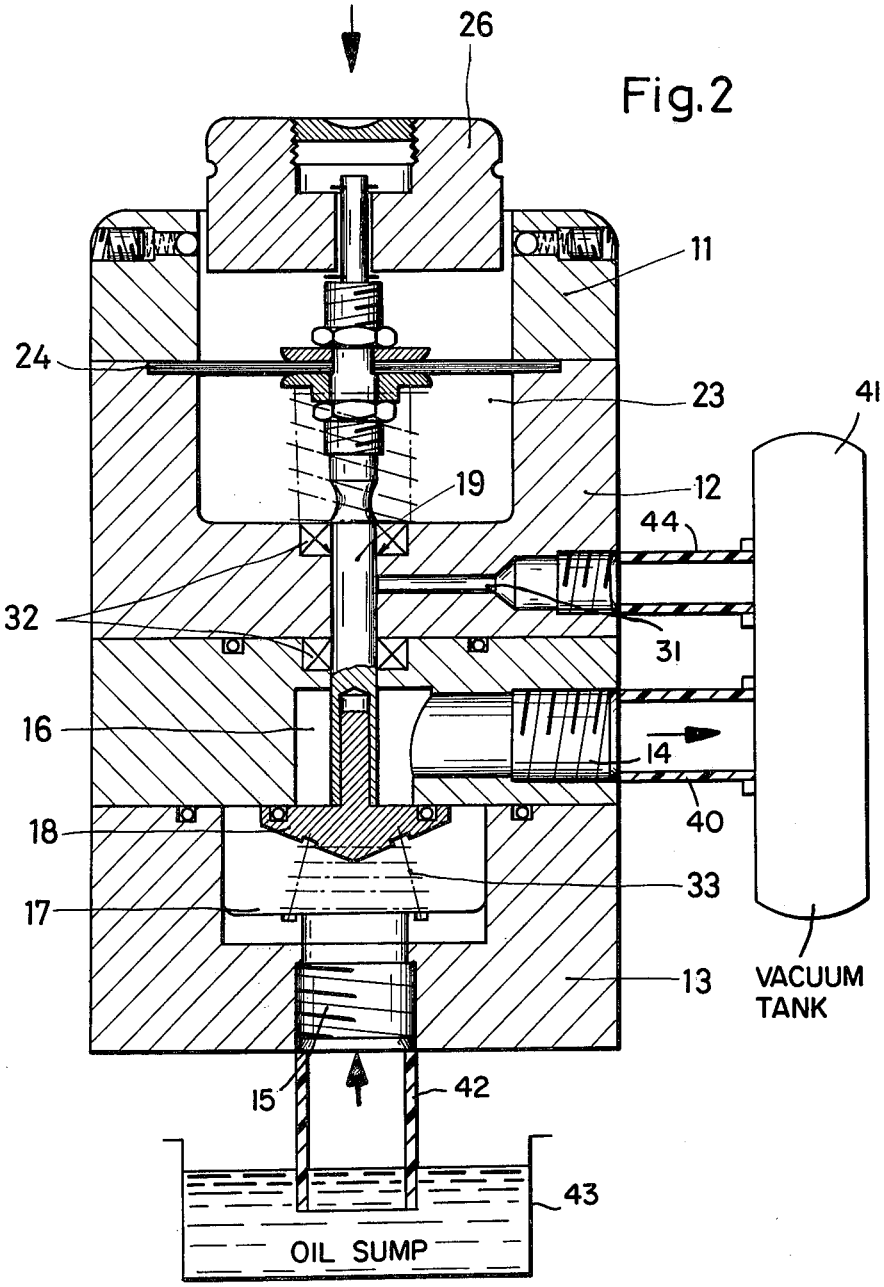
FIG. 2 is a sectional and partially schematic view similar to that of FIG. 1, but showing an alternate embodiment of the valve wherein it is fitted with an additional control line for a control member.

The embodiment illustrated in FIG. 2 substantially conforms to that shown on FIG. 1 except that the central valve casing portion 12 includes an additional control port in the form of a transversal bore 31 having a control line 44 to the vacuum tank 41 connected thereto. This additional control line 44 ensures that a reduction in vacuum that might occur in the suction line due to infiltration air cannot directly act on the control port 23 during an oil suction or drawing process because said control port is in direct communication with the vacuum tank via control bore 31 and is hence directly exposed to the pressure from the vacuum tank.

The transversal bore or passage 31 serving as a control port is additionally sealed against the cavity 16 of valve chamber 17 by means of an annular seal 32 which prevents that pressure from the suction line connected to the bores 14, 15 can act on control port 23.

Whenever the suction oil filled vaccum tank is to be emptied by introduction of compressed air, the valve disk 18 is movably secured to the valve stem 19. An additional compression spring 33 is provided on the valve disk 18 to prevent the valve disk from making pulsating movements due to increase of pressure inside the suction line. Compressed air can be admitted to the tank through the same line through which oil has been drawn from the engine's crankcase and through which line the oil contained in the tank will then be pressed out.

While only certain embodiments of the invention have been illustrated and described it is apparent that alterations, modifications and changes may be made without departing from the true scope and spirit thereof as defined by the appended claims.

What I claim is:

1. A valve for use in connection with a device for removing oil from an oil-containing chamber of a combustion engine of the type which includes a vacuum tank having a chamber which may be at least partially evacuated to establish a subatmospheric pressure condition therein and a suction hose having two ends, one of which serves as a nozzle for insertion into the oil-containing chamber of the engine, comprising:

a valve housing having interior walls which define therein a valve seat, an inlet chamber disposed on one side of said valve seat which is capable of communication with the other end of the suction hose, an outlet channel disposed on the other side of said valve seat which is capable of communication with the chamber of the vacuum tank and a control chamber which is communicative with said outlet channel and which has an opening which opens onto the exterior surface of said valve housing;

a valve locking member having an upstanding valve stem coupled thereto which is movably mounted in said valve housing for reciprocal movement between an open and closed position relative to said valve seat;

sealing means which cooperate with said valve stem when said locking member is in said closed position thereof, for sealing off said control chamber from communication with said outlet channel; and a flexible diaphragm which is secured to said valve stem and is disposed within said control chamber with its marginal edges sealingly secured to the walls defining said control chamber so as to seal at least a portion of said chamber from the outside atmosphere, said diaphragm being at least partially responsive to a change in the pressure differential established on opposite sides thereof for moving said locking member to said closed position thereof following the completion of drawing oil from the oil containing chamber and into the vacuum tank as a result of the subatmospheric pressure condition established therein.

2. The valve according to claim 1, wherein said locking member is adjustably mounted on said valve stem and is spring-loaded to urge it into said closed position thereof.

3. The valve according to claim 1, wherein said flexible diaphragm has a major surface area portion which is freely movable and unclamped.

4. The valve according to claim 1 wherein said valve housing has a wall surface defining a generally cylindrical control passage, one end of which opens onto said control chamber and the other end of which opens onto said outlet channel for establishing communication between said control chamber and said outlet channel, wherein said sealing means includes an annular sealing gasket mounted within the wall surface defining said control passage with its inner marginal edges lying substantially flush with said wall surface, and wherein said valve stem has a cylindrical configuration and is dimensioned for substantially sealing and sliding engagement with said annular sealing gasket, said valve stem extending from said outlet channel through said control passage and into said control chamber and having a circumferentially-extending groove formed therein which is positioned and dimensioned so as to permit communication between said control chamber and said outlet channel when said locking member is in said open position thereof.

5. The valve according to claim 4, wherein said valve housing has a wall defining a control channel formed therein, one end of which is capable of communication with the chamber of the vacuum tank and the other end of which opens onto said control passage at a position whereat it will communicate with said groove of said stem, when said locking member is in said open position thereof.

6. The valve according to claim 1, additionally including an actuating member mounted on a free end of said valve stem which is disposed outwardly of said diaphragm, said actuating member being dimensioned and configured for slidable, mating receipt within said opening of said control chamber.

7. The valve according to claim 6, wherein said actuating member has a peripherally-extending groove formed therein and wherein said valve housing has mounted therein a spring-loaded abutment member projecting into the control chamber thereof, for releasable locking engagement with said groove of said actuating member, said groove being positioned on said actuating member such that when said abutment member engages said groove said locking member will be disposed in the open position thereof.

8. A device for removing oil from an oil containing chamber of a combustion engine, comprising:

a vacuum tank having a chamber which may be at least partially evacuated to establish a subatmospheric pressure condition therein;

a suction hose having two ends, one of which serves as a nozzle for insertion into the oil-containing chamber of the engine; and a valve having a valve housing having interior walls which define therein a valve seat, an inlet chamber disposed on one side of said valve seat which is capable of communication with the other end of the suction hose, an outlet channel disposed on the other side of said valve seat which is capable of communication with the chamber of the vacuum tank and a control chamber which is communicative with said outlet channel and which has an opening which opens onto the exterior surface of said valve housing, a valve locking member having an upstanding valve stem coupled thereto which is mounted in said valve housing for reciprocal movement between an open and closed position relative to said valve seat, sealing means which cooperate with said valve stem when said locking member is in said closed position thereof, for sealing off said control chamber from communication with said outlet channel, and a flexible diaphragm which is secured to said valve stem and is disposed within said control chamber with its marginal edges sealingly secured to the walls defining said control chamber so as to seal at least a portion of said chamber from the outside atmosphere, said diaphragm being at least partially responsive to a change in the pressure differential established on opposite sides thereof for moving said locking member to said closed position thereof following the completion of drawing oil from the oil-containing chamber and into the vacuum tank as a result of the subatmospheric pressure condition established therein.

9. The device according to claim 8, wherein said locking member is adjustably mounted on said valve stem and is spring-loaded to urge it into said closed position thereof.

10. The device according to claim 8, wherein said flexible diaphragm has a major surface area portion which is freely movable and unclamped.

11. The device according to claim 8, wherein said valve housing has a wall surface defining a generally cylindrical control passage, one end of which opens onto said control chamber and the other end of which opens onto said outlet channel for establishing communication between said control chamber and said outlet channel, wherein said sealing means includes an annular sealing gasket mounted within the wall surface defining said control passage with its inner marginal edges lying substantially flush with said wall surface, and wherein said valve stem has a cylindrical configuration and is dimensioned for substantially sealing and sliding engagement with said annular sealing gasket, said valve stem extending from said outlet channel through said control passage and into said control chamber and having a circumferentially-extending groove formed therein which is positioned and dimensioned so as to permit communication between said control chamber and said outlet channel when said locking member is in said open position thereof.

12. The device according to claim 11, wherein said valve housing has a wall defining a control channel formed therein, one end of which is capable of communication with the chamber of the vacuum tank and the other end of which opens onto said control passage at a position whereat it will communicate with said groove of said stem, when said locking member is in said open position thereof.

13. The device according to claim 8, additionally including an actuating member mounted on a free end of said valve stem which is disposed outwardly of said diaphragm, said actuating member being dimensioned and configured for slidable, mating receipt within said opening of said control chamber.

14. The device according to claim 13, wherein said actuating member has a peripherally-extending groove formed therein and wherein said valve housing has mounted therein a spring-loaded abutment member projecting into the control chamber thereof, for releasable locking engagement with said groove of said actuating member, said groove being positioned on said actuating member such that when said abutment member engages said groove said locking member will be disposed in the open position thereof.

* * * * *